US009671809B2

(12) United States Patent
Matsuda et al.

(10) Patent No.: US 9,671,809 B2
(45) Date of Patent: Jun. 6, 2017

(54) REACTIVE POWER COMPENSATION DEVICE HAVING FUNCTION OF DETECTING SYSTEM IMPEDANCE

(71) Applicant: MITSUBISHI ELECTRIC CORPORATION, Chiyoda-ku (JP)

(72) Inventors: Akihiro Matsuda, Chiyoda-ku (JP); Shinichi Ogusa, Chiyoda-ku (JP); Masatoshi Takeda, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 415 days.

(21) Appl. No.: 14/219,789

(22) Filed: Mar. 19, 2014

(65) Prior Publication Data

US 2015/0054473 A1 Feb. 26, 2015

(30) Foreign Application Priority Data

Aug. 20, 2013 (JP) ..... 2013-170397

(51) Int. Cl.
*G05F 1/70* (2006.01)

(52) U.S. Cl.
CPC ..... *G05F 1/70* (2013.01)

(58) Field of Classification Search
None
See application file for complete search history.

(56) References Cited

U.S. PATENT DOCUMENTS 5,798,634 A 8/1998 Terada et al.
7,225,087 B1 * 5/2007 Siciliano ..... H02J 3/38 702/58

(Continued)

FOREIGN PATENT DOCUMENTS

JP 62-203520 A 9/1987
JP A-8-103025 4/1996

(Continued)

OTHER PUBLICATIONS

Office Action (Notice of Grounds of Rejection) issued on Oct. 25, 2016, by the Japanese Patent Office in corresponding Japanese Patent Application No. 2013-170397, and an English Translation of the Office Action. (10 pages).

(Continued)

*Primary Examiner* — Nguyen Tran
*Assistant Examiner* — Monica Mata
(74) *Attorney, Agent, or Firm* — Buchanan Ingersoll & Rooney PC

(57) ABSTRACT

In a reactive power compensation device, a control unit controls a magnitude of reactive power to be output by a reactive power output unit, based on a detected system voltage and one or more control parameters in a first operation mode. In a second operation mode, the control unit changes the magnitude of the reactive power to be output by the reactive power output unit to a power system in an output change period, calculates system impedances of the power system at a plurality of detection time points within the output change period, based on change amounts of the system voltage detected at the plurality of detection time points and corresponding change amounts of the reactive power, and, when a variation in the calculated system impedances is within an acceptable range, adjusts the one or more control parameters, based on the calculated system impedances.

17 Claims, 13 Drawing Sheets

(56) References Cited

U.S. PATENT DOCUMENTS

| | | | | |
|---|---|---|---|---|
| 2008/0157728 | A1* | 7/2008 | Toki | H02J 3/1864 323/210 |
| 2011/0068631 | A1* | 3/2011 | Roscoe | H02J 3/38 307/69 |
| 2012/0280673 | A1* | 11/2012 | Watanabe | H02J 3/1885 323/304 |

FOREIGN PATENT DOCUMENTS

| | | | |
|---|---|---|---|
| JP | 2006-230050 | A | 8/2006 |
| JP | 2007-267440 | A | 10/2007 |
| JP | 2008-061360 | A | 3/2008 |
| JP | A-2008-89537 | | 4/2008 |
| JP | 2010-279115 | A | 12/2010 |

OTHER PUBLICATIONS

Feb. 21, 2017 Decision to Grant Patent issued in Japanese Application No. 2013-170397 by the Japanese Patent Office, 4 pages (with English language translation).

* cited by examiner

REACTIVE POWER COMPENSATION DEVICE HAVING FUNCTION OF DETECTING SYSTEM IMPEDANCE

BACKGROUND OF THE INVENTION

Field of the Invention

The present invention relates to a reactive power compensation device (Static Var Compensator: SVC) adjusting a system voltage by supplying reactive power to a power system, and a reactive power compensation system including a plurality of reactive power compensation devices.

Description of the Background Art

A conventional reactive power compensation device slightly changes reactive power to be injected into a power system, and calculates a system impedance, based on the relationship between a change amount of a system voltage and a change amount of the reactive power on that occasion. The reactive power compensation device adjusts one or more control parameters of control means controlling an output amount of the reactive power, using the calculated system impedance. As a result, optimal reactive power compensation can be performed (see, for example, Japanese Patent Laying-Open No. 2007-267440 and Japanese Patent Laying-Open No. 62-203520).

In the conventional reactive power compensation device, since the system impedance is calculated based on the change amount of the system voltage produced when the reactive power to be injected into the power system is changed as described above, the system impedance cannot be determined correctly when the system voltage is changed due to a factor other than injection of the reactive power. For example, the system voltage is changed when a phase-modifying capacitor or a shunt reactor is closed or opened or large-sized load equipment such as a motor is activated or stopped in the vicinity of the reactive power compensation device. When the system voltage is changed due to such an external factor while an injection amount of the reactive power is slightly changed, accuracy in detecting the system impedance is deteriorated, and as a result, the system voltage cannot be controlled appropriately.

SUMMARY OF THE INVENTION

One object of the present invention is to provide a reactive power compensation device capable of improving controllability over a system voltage by determining a system impedance more accurately than ever before.

A reactive power compensation device in accordance with one embodiment includes a reactive power output unit outputting reactive power to a power system, a voltage detection unit detecting a system voltage of the power system, and a control unit having first and second operation modes. In the first operation mode, the control unit controls a magnitude of the reactive power to be output by the reactive power output unit, based on the detected system voltage and one or more control parameters. In the second operation mode, the control unit provides an output change period, and changes the magnitude of the reactive power to be output by the reactive power output unit to the power system in the output change period. In the second operation mode, the control unit further calculates system impedances of the power system at a plurality of detection time points within the output change period, based on change amounts of the system voltage detected at the plurality of detection time points and corresponding change amounts of the reactive power, and, when a variation in the calculated system impedances is within an acceptable range, adjusts the one or more control parameters, based on the calculated system impedances.

According to the above embodiment, the system impedance can be determined more accurately than ever before, and thus controllability over the system voltage can be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
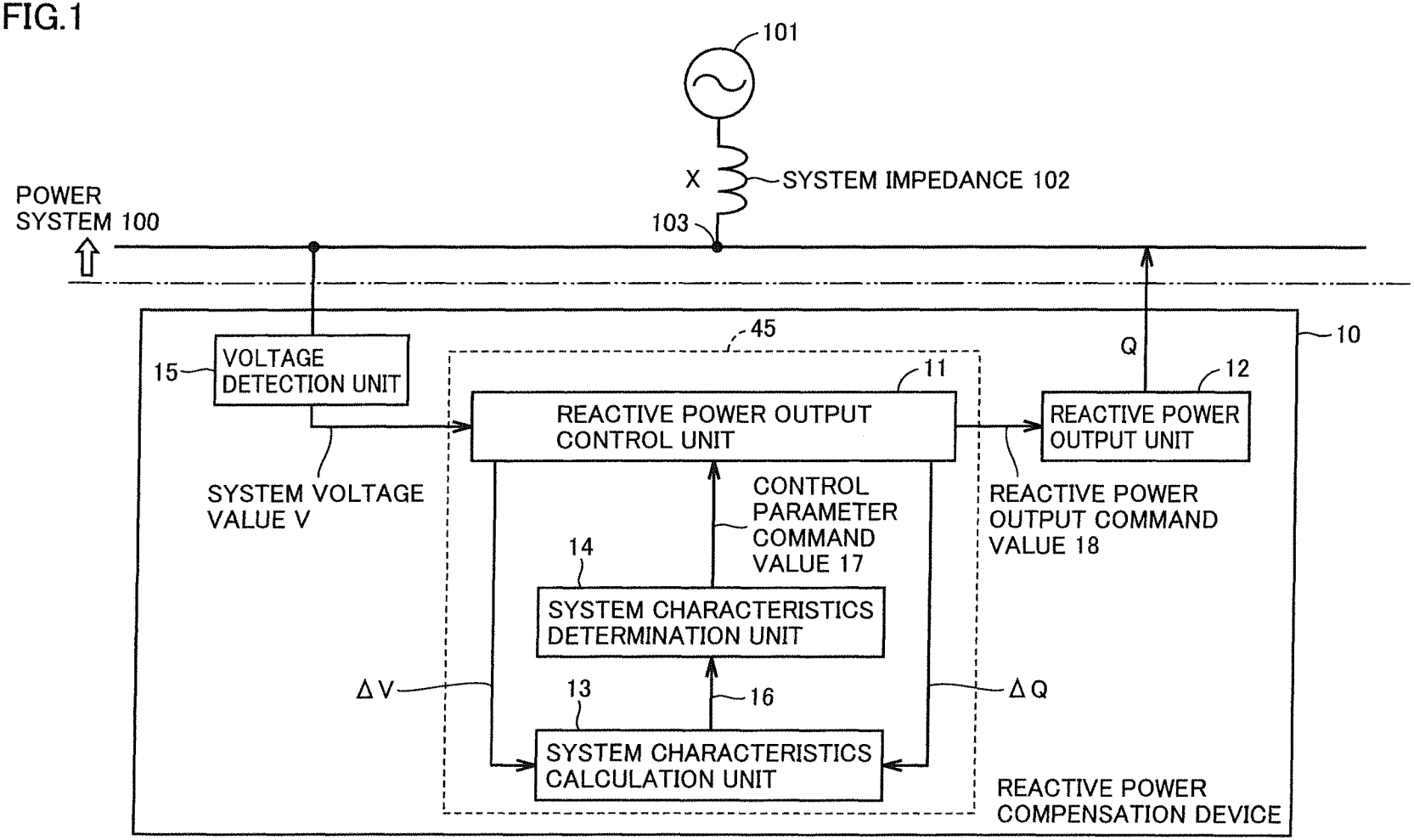
FIG. 1 is a block diagram showing a configuration of a reactive power compensation device in accordance with Embodiment 1.

Hereinafter, embodiments of the present invention will be described in detail with reference to the drawings. It is noted that identical or corresponding parts will be designated by the same reference numerals, and the description thereof will not be repeated.

Embodiment 1

Overall Configuration of Reactive Power Compensation Device

FIG. 1 is a block diagram showing a configuration of a reactive power compensation device 10 in accordance with Embodiment 1. Referring to FIG. 1, reactive power compensation device 10 is connected to a power system 100 via an interconnection point 103. Power system 100 upstream of interconnection point 103 can be represented by a system power source 101 and a system impedance (Zs) 102. System impedance 102 is approximately represented by a reactance X.

Reactive power compensation device 10 continuously and quickly controls reactive power to be supplied to power system 100 by using power electronics, and thereby adjusts a system voltage V of power system 100 (i.e., a voltage at interconnection point 103) to be within an appropriate range or to have an appropriate value. As shown in FIG. 1, reactive power compensation device 10 in accordance with Embodiment 1 includes a voltage detection unit 15, a reactive power output unit 12, a reactive power output control unit 11, a system characteristics calculation unit 13, and a system characteristics determination unit 14.

Voltage detection unit 15 detects system voltage V of power system 100 (i.e., the voltage at interconnection point 103). Voltage detection unit 15 includes, for example, an instrument transformer.

Reactive power output unit 12 outputs reactive power Q having a magnitude in accordance with a reactive power output command value 18 output from reactive power output control unit 11, to power system 100. For reactive power output unit 12, various schemes such as a Thyristor Controlled Reactor (TCR) scheme, a Thyristor Switched Capacitor (TSC) scheme, and a Static Synchronous Compensator (STATCOM) scheme can be used.

In the cases of the TCR scheme and the TSC scheme, reactive power output unit 12 includes a step-down transformer, a reactor, a capacitor, and a thyristor switch. In these cases, ON/OFF states of the thyristor switch are controlled in accordance with reactive power output command value 18. In the case of the STATCOM scheme, reactive power output unit 12 includes a step-down transformer and an inverter circuit. In this case, ON/OFF states of a switch element constituting the inverter circuit are controlled in accordance with reactive power output command value 18.

Reactive power output control unit 11 includes a normal mode and a system impedance measurement mode (hereinafter referred to as a "Zs measurement mode"), as operation modes. In the normal mode, reactive power output control unit 11 generates appropriate reactive power output command value 18, based on system voltage V detected at voltage detection unit 15 and various control parameters, and outputs generated reactive power output command value 18 to reactive power output unit 12. Reactive power Q is output from reactive power output unit 12 to power system 100 in accordance with reactive power output command value 18, and thereby system voltage V is adjusted to be within the most appropriate range or to have an appropriate value.

In contrast, in the Zs measurement mode, reactive power output control unit 11 stops the control operation performed in the normal mode described above. Using an output value of the reactive power immediately before a shift to the Zs measurement mode as a reference level, reactive power output control unit 11 controls reactive power output unit 12 to supply, to power system 100, reactive power Q in the shape of a single pulse slightly changed from the reference level for a predetermined output change period. Voltage detection unit 15 detects system voltage V at a plurality of detection time points within the output change period. The output change period is, for example, about one second, and the system voltage is detected a plurality of times at an interval of, for example, about 0.1 seconds. System voltage V is also slightly changed corresponding to a change amount ΔQ of the reactive power. A change amount ΔV of the system voltage is, for example, about 0.3%.

In the Zs measurement mode, system characteristics calculation unit 13 calculates a system impedance X, based on change amount ΔV of the system voltage obtained at each detection time point within the output change period and corresponding change amount ΔQ of the reactive power. System impedance X is given by:

$$X=\Delta V/\Delta Q \quad (1).$$

System characteristics determination unit 14 determines whether or not a variation in a plurality of system impedances calculated by system characteristics calculation unit 13 in the Zs measurement mode is within an acceptable range. For example, if the variation in the calculated plurality of system impedances is within ±50%, system characteristics determination unit 14 determines that the variation is within the acceptable range. When the variation in the calculated system impedances is within the acceptable range, system characteristics determination unit 14 outputs one or more control parameter command values 17 for adjusting one or more control parameters to reactive power output control unit 11, based on the calculated system impedances.

In the present specification, reactive power output control unit 11, system characteristics calculation unit 13, and system characteristics determination unit 14 described above will be collectively referred to as a control unit 45. Control unit 45 may be configured with a computer including a processor, a memory, and the like, or may be configured with a dedicated electronic circuit. Alternatively, a portion of control unit 45 may be configured with a computer, and the remaining portion thereof may be configured with a dedicated electronic circuit.

[Exemplary Configuration of Reactive Power Output Control Unit]

Figure 2:
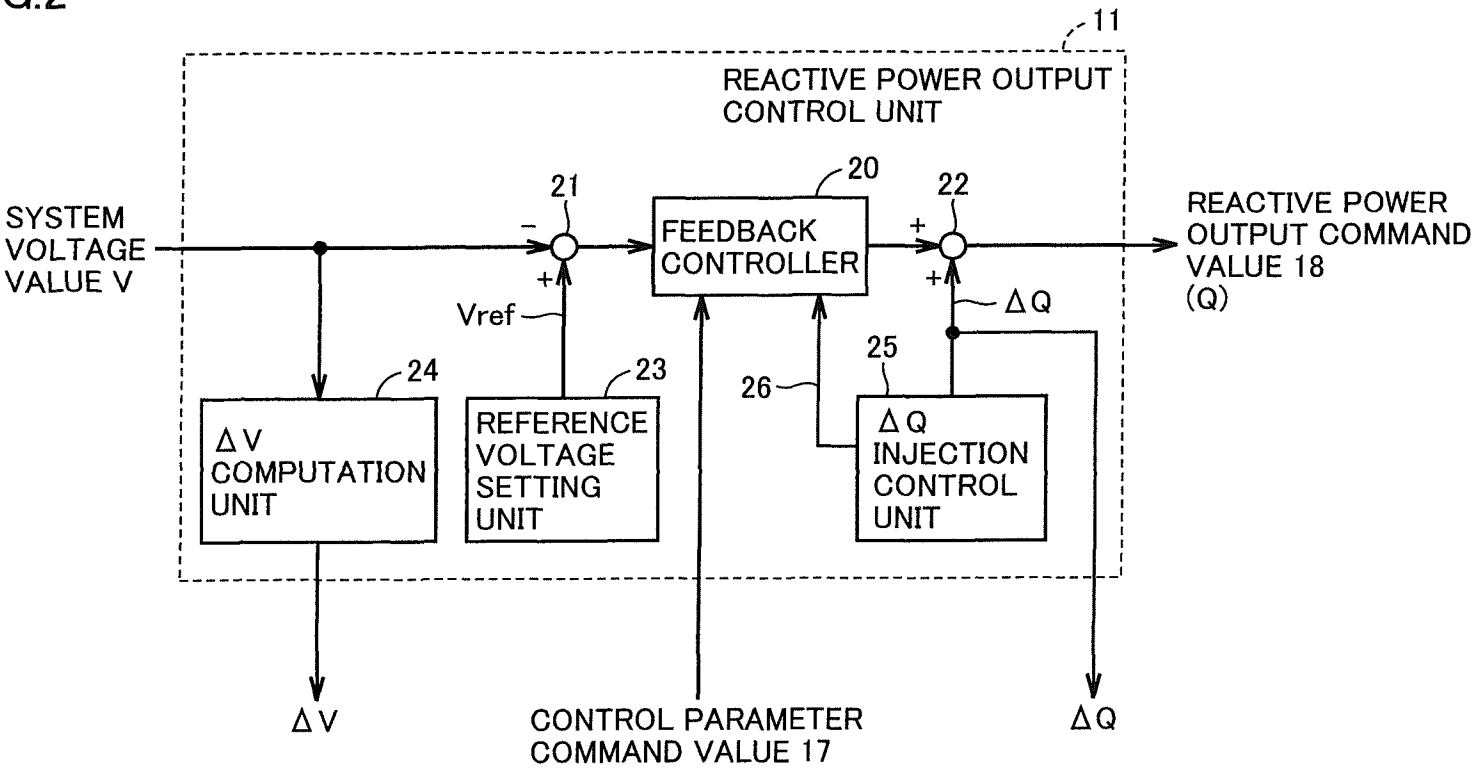
FIG. 2 is a block diagram showing one example of a functional configuration of a reactive power output control unit in FIG. 1.

FIG. 2 is a block diagram showing one example of a functional configuration of reactive power output control unit 11 in FIG. 1. Referring to FIG. 2, reactive power output control unit 11 includes a feedback controller 20, a subtracter 21, an adder 22, a reference voltage setting unit 23, a ΔV computation unit 24, and a ΔQ injection control unit 25.

Reference voltage setting unit 23 is, for example, a register holding a reference voltage Vref. Subtracter 21 calculates a deviation between reference voltage Vref and system voltage value V.

Feedback controller 20 performs a control computation on the deviation between reference voltage Vref and system voltage value V. Feedback controller 20 performs, for example, a proportional computation (P computation), a proportional-integral computation (PI computation), or a proportional-integral-derivative computation (PID computation). In the normal mode, an output of feedback controller 20 is output as reactive power output command value 18 to reactive power output unit 12 in FIG. 1.

In the Zs measurement mode, an output of feedback controller 20 is fixed to an output value immediately before the shift to the Zs measurement mode, in accordance with a control signal 26 from ΔQ injection control unit 25. Further, in the Zs measurement mode, a single pulse signal (ΔQ) output from ΔQ injection control unit 25 is added to the output of feedback controller 20. As a result, the reactive power to be output from reactive power output unit 12 in FIG. 1 to power system 100 is continuously changed from the reference level for the predetermined output change period. Change amount ΔV of the system voltage corresponding to this change amount ΔQ of the reactive power is calculated by ΔV computation unit 24.

As described in FIG. 1, system impedance X is calculated from change amount ΔQ of the reactive power and change amount ΔV of the system voltage. Control parameters of feedback controller 20 (for example, a proportional gain, an integral time, a derivative time, and the like in the case of PID control) are adjusted in accordance with system impedance X. This is because there is a possibility that, even if change amount ΔQ of the injected reactive power is the same, the system voltage may be changed too much or may become unstable depending on the magnitude of the system impedance.

It is noted that the configuration of reactive power output control unit 11 shown in FIG. 2 is merely one example. Although not shown in FIG. 2, for example, at least one of a power flow of power system 100, a value of a current flowing through power system 100, an output current of reactive power compensation device 10, and the like may be used as an input of a reactive power output amount control circuit, instead of the system voltage value.

[Operation of Reactive Power Compensation Device]

Figure 3:
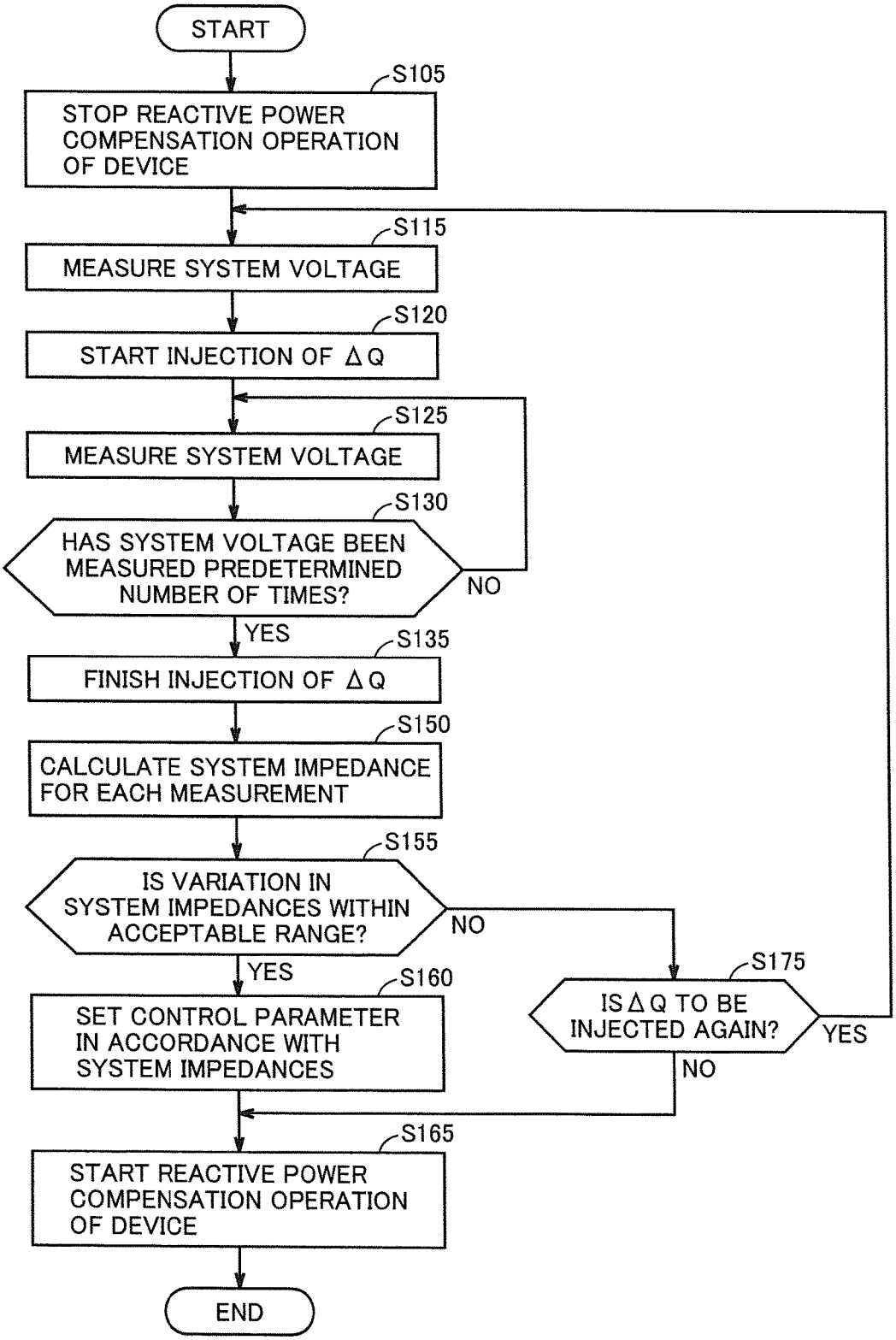
FIG. 3 is a flowchart illustrating an operation of the reactive power compensation device in FIG. 1 in a Zs measurement mode.
Figure 4:
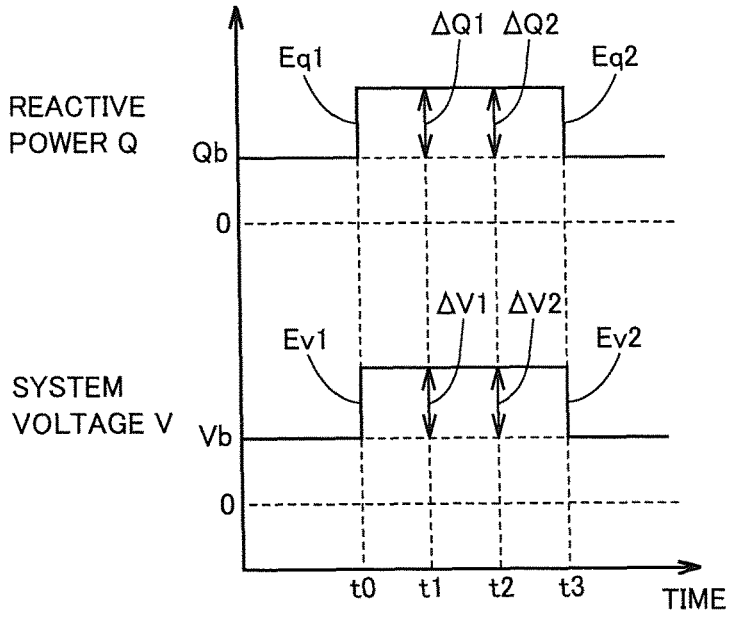
FIG. 4 is a view schematically showing one example of a waveform of injected reactive power and a waveform of a system voltage in the Zs measurement mode.

FIG. 3 is a flowchart illustrating an operation of reactive power compensation device 10 in FIG. 1 in the Zs measurement mode. FIG. 4 is a view schematically showing one example of a waveform of injected reactive power Q and a waveform of system voltage V in the Zs measurement mode. It is noted that scales on the axis of ordinates and the axis of abscissas in FIG. 4 are not proportional to actual values. The same applies to FIGS. 5, 6, 8, and 9. Hereinafter, an operation of reactive power compensation device 10 in FIG. 1 in the Zs measurement mode will be described in further detail with reference to FIGS. 1, 3, and 4.

When a shift from the normal mode to the Zs measurement mode occurs, reactive power output control unit 11 stops a reactive power compensation operation (step S105). As shown in FIG. 4, an reactive power injection amount to be injected into power system 100 at the time of the shift to the Zs measurement mode is indicated as Qb. Voltage detection unit 15 detects the system voltage at the time of the shift to the Zs measurement mode (i.e., Vb in FIG. 4) (step S115). The detected system voltage value is stored in a memory (not shown) in reactive power output control unit 11.

Next, using reactive power injection amount Qb at the time of the shift to the Zs measurement mode as a reference level, reactive power output unit 12 outputs, to power system 100, the reactive power in the shape of a single pulse (in the case of FIG. 4, having a rectangular waveform) slightly changed from the reference level for an output change period from a time t0 to a time t3 in FIG. 4, in response to reactive power output command value 18 from reactive power output control unit 11 (steps S120 to S135). In other words, minute reactive power ΔQ in the shape of a single pulse is injected into power system 100, in addition to reactive power Qb at the reference level.

In the output change period (from time t0 to time t3 in FIG. 4), voltage detection unit 15 measures system voltage V a predetermined number of times (twice or more) (steps S125, S130). Each detected system voltage value is associated with change amount ΔQ of the reactive power and stored in the memory (not shown) in reactive power output control unit 11.

Thereby, n (in the case of FIG. 4, n=2) combinations of change amounts ΔQ of the reactive power and respectively corresponding change amounts ΔV of the system voltage from reference level Vb, that is, (ΔQ1, ΔV1), (ΔQ2, ΔV2), . . . , (ΔQn, ΔVn) are obtained corresponding to a plurality of detection times (times t1 and t2 in FIG. 4) in the output change period (from time t0 to time t3 in FIG. 4), respectively.

Next, system characteristics calculation unit 13 calculates n (n≥2) system impedance values X1, . . . , Xn according to equation (1) described above, based on the n combinations of change amounts ΔQi of the reactive power and change amounts ΔVi of the system voltage (where i=1, 2, . . . , n) (step S150). Calculation of the system impedance can be performed even during injection of the minute reactive power, whenever corresponding change amount of the reactive power and change amount of the system voltage are detected.

Next, system characteristics determination unit 14 determines whether or not a variation in the calculated n system impedance values is within an acceptable range (step S155). For example, if the variation in the calculated plurality of system impedances is within ±50%, system characteristics determination unit 14 determines that the variation is within the acceptable range.

When the variation in the calculated plurality of system impedance values is within the acceptable range (YES in step S155), system characteristics determination unit 14 adjusts one or more control parameters to be used in reactive power output control unit 11 in accordance with the calculated system impedances (step S160). That is, system characteristics determination unit 14 outputs one or more control parameter command values 17 in accordance with the calculated system impedance values to reactive power output control unit 11. In this case, the one or more control parameters may be adjusted using an average value of calculated system impedances X1, . . . , Xn, or if n is an odd number, the one or more control parameters may be adjusted using a median value of calculated system impedances X1, . . . , Xn. Alternatively, any one or a plurality of combinations of system impedance values may be used, or the calculated plurality of system impedance values other than the maximum value and the minimum value thereof may be used.

Thereafter, when the operation mode returns from the Zs measurement mode to the normal mode, reactive power output control unit 11 resumes the reactive power compensation operation (step S165).

On the other hand, when the variation in the calculated plurality of system impedance values is not within the acceptable range (NO in step S155), reactive power output control unit 11 may inject minute reactive power ΔQ again into power system 100 by reactive power output unit 12 (YES in step S175), or may return the operation mode to the normal mode without injecting minute reactive power ΔQ again (NO in step S175).

Figure 5:
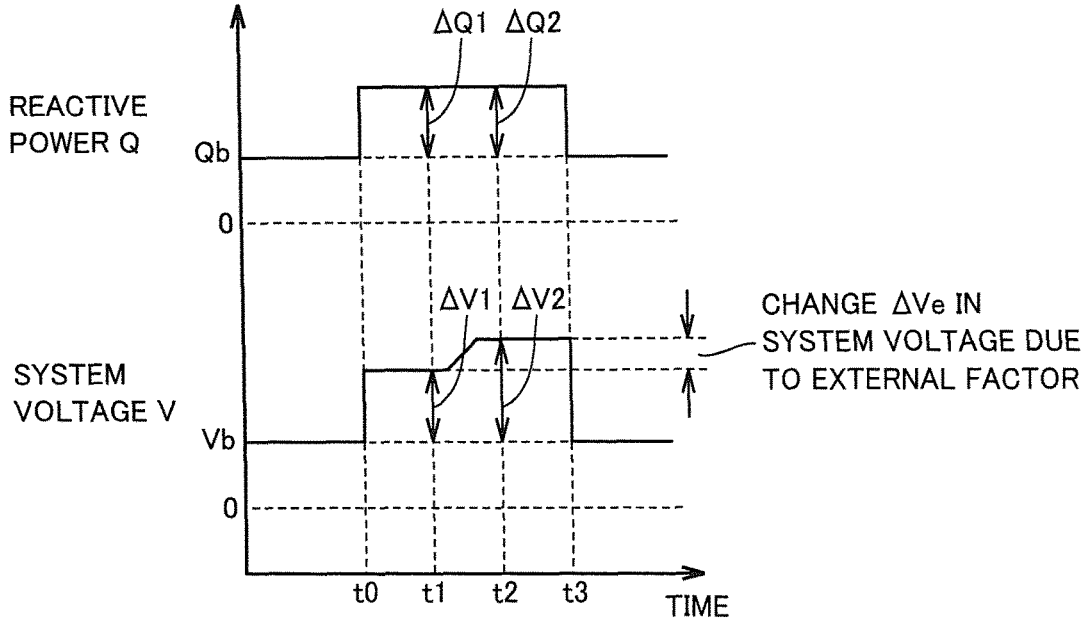
FIG. 5 is a view schematically showing one example of a waveform of the injected reactive power and a waveform of the system voltage in a case where the system voltage is changed due to an external factor.

FIG. 5 is a view schematically showing one example of a waveform of injected reactive power Q and a waveform of system voltage V in a case where system voltage V is changed due to an external factor. Referring to FIG. 5, the system voltage is changed by ΔVe due to an external factor in a period from time t1 to time t2. Examples of the external factor include closing or opening of a phase-modifying capacitor or a shunt reactor or activation or stop of large-sized load equipment such as a motor placed in the vicinity of reactive power compensation device 10.

In the case of FIG. 5, system impedance value X1 based on change amount ΔQ1 of the reactive power and change amount ΔV1 of the system voltage detected at time t1 differs widely from system impedance value X2 based on change amount ΔQ2 of the reactive power and change amount ΔV2 of the system voltage detected at time t2. That is, calculated system impedance value X2 is inappropriate, and it is not possible to appropriately set the one or more control parameters of reactive power output control unit 11, based on system impedance value X2.

In Embodiment 1, system characteristics determination unit 14 in FIG. 1 determines whether or not a variation in the calculated system impedance values is within an acceptable range, and only when the variation is within the acceptable range, system characteristics determination unit 14 adjusts one or more control parameters in accordance with the calculated system impedance values. Therefore, the one or more control parameters of reactive power output control unit 11 can be set appropriately by avoiding false detection of the system impedance, and as a result, controllability over system voltage V of power system 100 can be improved.

Effect of Embodiment 1

As described above, according to reactive power compensation device 10 in accordance with Embodiment 1, when the injected reactive power is slightly changed in the Zs measurement mode, a change in the system voltage is detected a plurality of times, and a plurality of system impedance values are calculated based on these detection results. Then, if a variation in the calculated plurality of system impedance values is within an acceptable range, one or more control parameters of the reactive power output control unit are adjusted based on the calculated system impedances. Thereby, the one or more control parameters of the reactive power output control unit can be set appropriately by avoiding influence of the change in the system voltage due to an external factor. As a result, controllability of the reactive power compensation device over the system voltage can be improved.

Embodiment 2

In a reactive power compensation device in accordance with Embodiment 2, reactive power Q to be injected from reactive power output unit 12 into power system 100 in FIG. 1 in the Zs measurement mode has a waveform different from that in Embodiment 1. Hereinafter, a specific description will be given with reference to the drawings.

Referring to FIGS. 1 and 4, in Embodiment 1, minute reactive power ΔQ superimposed on reactive power Qb at the reference level in the output change period (from time t0 to time t3) in the Zs measurement mode has a rectangular waveform. Thus, reactive power Q injected into power system 100 has steep changes Eq1, Eq2 (i.e., edge portions in a rectangular wave), and as a result, system voltage V also has steep changes Ev1, Ev2. A steep change in the system voltage is undesirable because it may lead to a false operation of a relay and resultant load drop-off and change in frequency, and the like. In Embodiment 2, the waveform of the reactive power to be injected in the Zs measurement mode is modified to solve the above problem.

Figure 6:
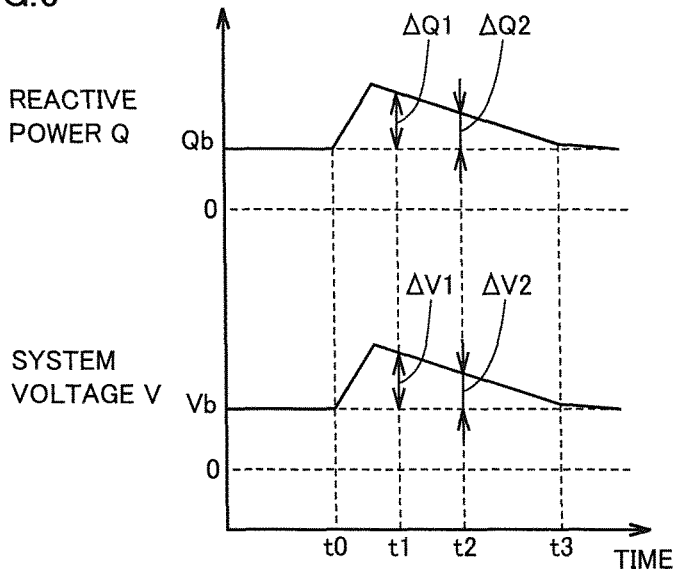
FIG. 6 is a view schematically showing one example of a waveform of the injected reactive power and a waveform of the system voltage in the Zs measurement mode in a reactive power compensation device in accordance with Embodiment 2.

FIG. 6 is a view schematically showing one example of a waveform of injected reactive power Q and a waveform of system voltage V in the Zs measurement mode in the reactive power compensation device in accordance with Embodiment 2. As shown in FIG. 6, in Embodiment 2, minute reactive power ΔQ having a triangular waveform instead of a rectangular waveform is injected into power system 100 in the Zs measurement mode. As a result, a change in the system voltage also has a substantially triangular waveform, and thus the system impedance can be detected without causing a steep change in the system voltage. Other than that, Embodiment 2 is identical to Embodiment 1, and the description thereof will not be repeated.

Embodiment 3

In a reactive power compensation device in accordance with Embodiment 3, reactive power Q to be injected from reactive power output unit 12 into power system 100 in FIG. 1 in the Zs measurement mode has a waveform different from those in Embodiments 1 and 2. Hereinafter, a specific description will be given with reference to the drawings.

Figure 7:
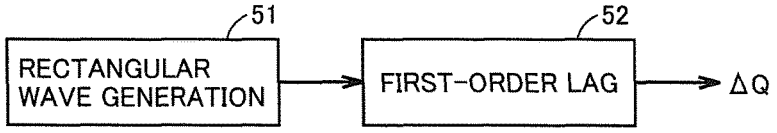
FIG. 7 is a view for illustrating a method for generating minute reactive power to be injected into a power system in the Zs measurement mode in a reactive power compensation device in accordance with Embodiment 3.

FIG. 7 is a view for illustrating a method for generating minute reactive power ΔQ to be injected into the power system in the Zs measurement mode in the reactive power compensation device in accordance with Embodiment 3. With reference to FIG. 7, in Embodiment 3, command value ΔQ to be output from ΔQ injection control unit 25 in FIG. 2 is generated by applying a first-order lag transfer function ($1/(1+T\cdot s)$, where T is a lag time) by a first-order lag element unit 52 to a rectangular wave output from a rectangular wave generation unit 51.

Figure 8:
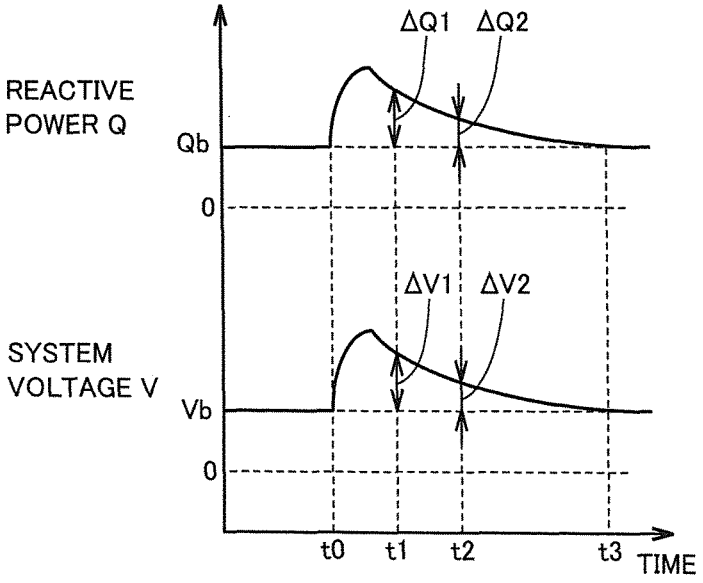
FIG. 8 is a view schematically showing one example of a waveform of the injected reactive power and a waveform of the system voltage in the Zs measurement mode in the reactive power compensation device in accordance with Embodiment 3.

FIG. 8 is a view schematically showing one example of a waveform of injected reactive power Q and a waveform of system voltage V in the Zs measurement mode in the reactive power compensation device in accordance with Embodiment 3. Referring to FIG. 8, in Embodiment 3, a changed portion of reactive power Q injected into power system 100 in the output change period (from time t0 to time t3) in the Zs measurement mode has a waveform generated by applying a first-order lag transfer function to a rectangular wave, as described in FIG. 7. As a result, a changed portion of system voltage V also has a similar waveform, and thus the system impedance can be detected without causing a steep change in the system voltage. Other than that, Embodiment 3 is identical to Embodiment 1, and the description thereof will not be repeated.

Embodiment 4

Figure 9:
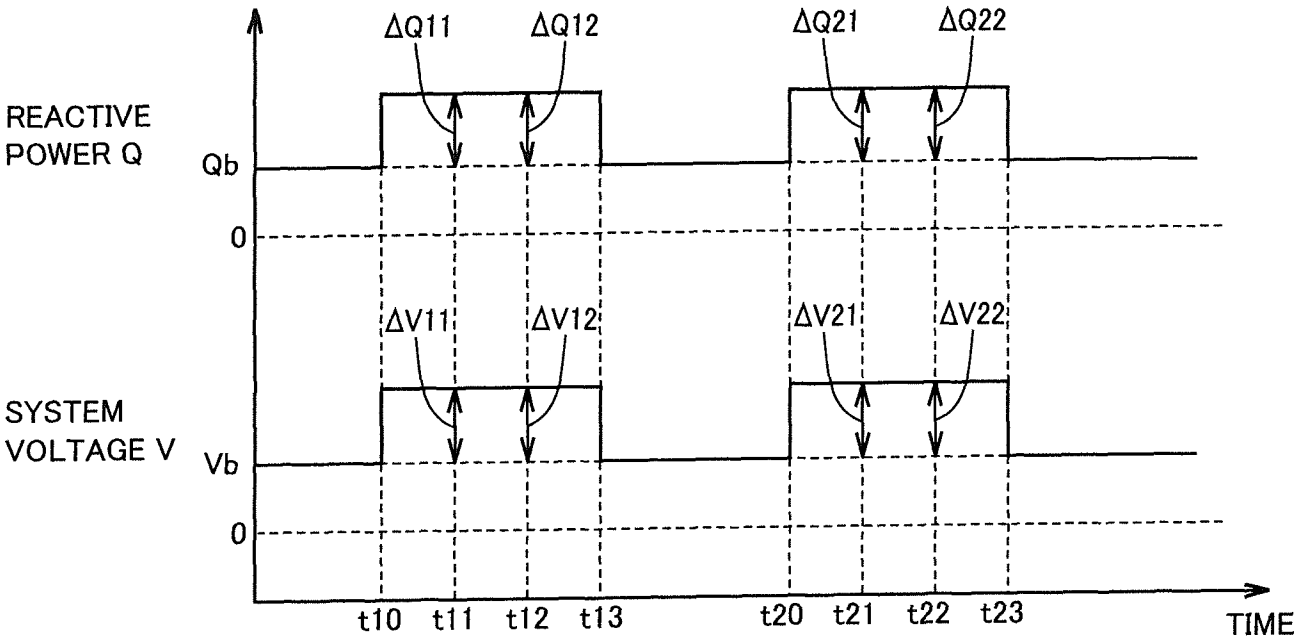
FIG. 9 is a view schematically showing one example of a waveform of the injected reactive power and a waveform of the system voltage in the Zs measurement mode in a reactive power compensation device in accordance with Embodiment 4.

FIG. 9 is a view schematically showing one example of a waveform of injected reactive power Q and a waveform of system voltage V in the Zs measurement mode in a reactive power compensation device in accordance with Embodiment 4.

Referring to FIGS. 1 and 9, in Embodiment 4, a plurality of output change periods (in the case of FIG. 9, two periods, i.e., from a time t10 to a time t13 and from a time t20 to a time t23) are provided in the Zs measurement mode. In each output change period, the reactive power to be output from reactive power output unit 12 to power system 100 is continuously changed from reference level Qb. Voltage detection unit 15 detects system voltage V at a plurality of detection time points within each output change period (in the case of FIG. 9, times t11, t12 in a first output change period and times t21, t22 within a second output change period).

Thereby, plural combinations of change amounts ΔQ of the reactive power and change amounts ΔV of the system voltage are obtained for each output change period. Specifically, in the case of FIG. 9, (ΔQ11, ΔV11), (ΔQ12, ΔV12) are obtained in the first output change period, and (ΔQ21, ΔV21), (ΔQ22, ΔV22) are obtained in the second output change period.

Figure 10:
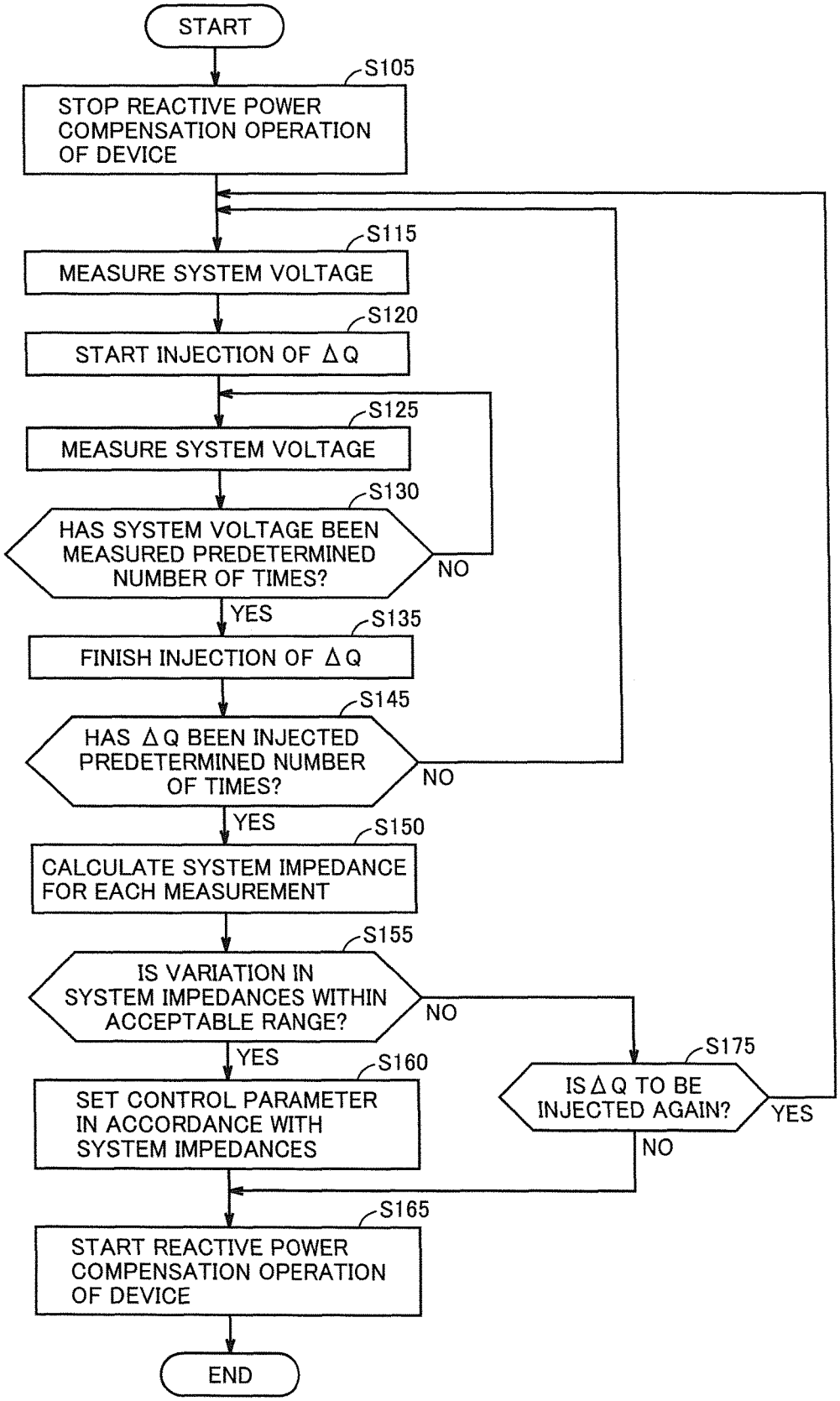
FIG. 10 is a flowchart illustrating an operation of the reactive power compensation device in accordance with Embodiment 4 in the Zs measurement mode.

FIG. 10 is a flowchart illustrating an operation of the reactive power compensation device in accordance with Embodiment 4 in the Zs measurement mode. The flowchart of FIG. 10 is different from the flowchart in Embodiment 1 described in FIG. 3 in that step S145 is added. In step S145, it is determined whether or not injection of minute reactive power ΔQ has been repeated a predetermined number of times. If the number of injections does not reach the predetermined number of times, steps S115 to S135 are repeated. If the number of injections reaches the predetermined number of times (YES in step S145), in next step S150, the system impedance is calculated for each of the plurality of detection time points in each output change period.

In next step S155, it is determined whether or not a variation in the calculated plurality of system impedances is within an acceptable range. Specifically, in the case of FIG. 9, system characteristics determination unit 14 in FIG. 1 determines whether or not a variation in system impedances X11 (=ΔV11/ΔQ11) and X12 (=ΔV12/ΔQ12) corresponding to the first output change period is within an acceptable range, and then determines whether or not a variation in system impedances X21 (=ΔV21/ΔQ21) and X22 (=ΔV22/ΔQ22) corresponding to the second output change period is within an acceptable range. Further, system characteristics determination unit 14 determines whether or not a variation between system impedances X11, X12 corresponding to the first output change period and system impedances X21, X22 corresponding to the second output change period is within an acceptable range.

Since only one output change period is provided in Embodiment 1 shown in FIG. 4, for example if the system voltage is changed due to an external factor immediately before time t0 and the change in the system voltage continues for the output change period, it is not possible to detect the change in the system voltage due to the external factor as a variation in the calculated plurality of system impedances. In contrast, in Embodiment 4, by providing a plurality of output change periods in the Zs measurement mode, a case where the system voltage is changed due to an external factor is detected more correctly, and as a result, the system impedance can be detected more accurately.

Other than that, Embodiment 4 is identical to Embodiments 1 to 3, and the description thereof will not be repeated. For example, although a changed portion of the reactive power injected in the output change period in FIG. 9 has a rectangular waveform, it can also have a triangular waveform as shown in FIG. 6, or a waveform generated by applying a first-order lag transfer function to a rectangular wave as shown in FIG. 8.

Embodiment 5

In Embodiment 5, a description will be given of a case where another reactive power compensation device 30 is also connected to power system 100 having reactive power compensation device 10 connected thereto, and as a result, compensation operations of reactive power compensation devices 10 and 30 affect each other. Since reactive power compensation devices 10 and 30 in accordance with Embodiment 5 operate in concert with each other as described below, it can be considered that both reactive power compensation devices 10 and 30 constitute a reactive power compensation system.

Figure 11:
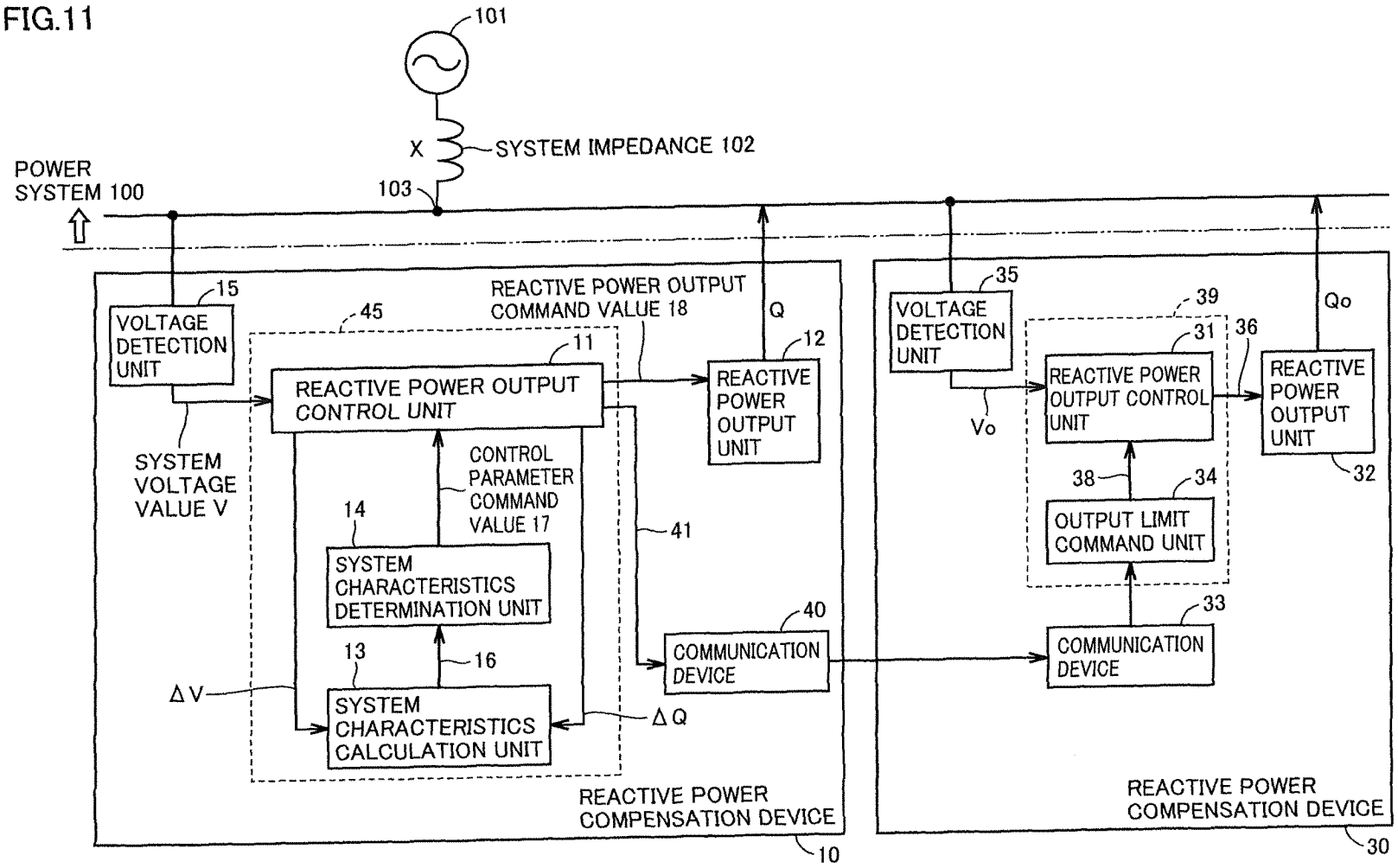
FIG. 11 is a block diagram showing a configuration of two reactive power compensation devices connected to a power system 100.

FIG. 11 is a block diagram showing a configuration of two reactive power compensation devices 10, 30 connected to power system 100. Referring to FIG. 11, reactive power compensation device 10 is different from reactive power compensation device 10 in FIG. 1 in that it further includes a communication device 40 capable of communicating with reactive power compensation device 30. When a shift from the normal mode to the Zs measurement mode occurs and when a shift from the Zs measurement mode to the normal mode occurs, reactive power output control unit 11 notifies the other reactive power compensation device 30 of information 41 regarding the shifts, via communication device 40. Other than that, reactive power compensation device 10 in FIG. 11 is identical to that in FIG. 1, and thus identical or corresponding parts will be designated by the same reference numerals and the description thereof will not be repeated.

The other reactive power compensation device 30 includes a voltage detection unit 35, a reactive power output unit 32, a reactive power output control unit 31, an output limit command unit 34, and a communication device 33 capable of communicating with reactive power compensation device 10. In the present specification, reactive power output control unit 31 and output limit command unit 34 described above will be collectively referred to as a control unit 39. Control unit 39 may be configured with a computer including a processor, a memory, and the like, or may be configured with a dedicated electronic circuit. Alternatively, a portion of control unit 39 may be configured with a computer, and the remaining portion thereof may be configured with a dedicated electronic circuit.

Voltage detection unit 35 detects a system voltage of power system 100 (i.e., a voltage Vo in the vicinity of reactive power compensation device 30). Voltage detection unit 35 includes, for example, an instrument transformer.

Reactive power output unit 32 outputs reactive power Qo having a magnitude in accordance with a reactive power output command value 36 output from reactive power output control unit 31, to power system 100. For reactive power output unit 32, various schemes such as the TCR scheme, the TSC scheme, and the STATCOM scheme can be used.

Reactive power output control unit 31 generates appropriate reactive power output command value 36, based on system voltage Vo detected at voltage detection unit 35 and various control parameters, and outputs generated reactive power output command value 36 to reactive power output unit 32. Reactive power Qo is output from reactive power output unit 32 to power system 100 in accordance with reactive power output command value 36, and thereby system voltage Vo is adjusted to be within the most appropriate range or to have an appropriate value.

When output limit command unit 34 detects, via communication device 33, that reactive power compensation device 10 is in the Zs measurement mode, output limit command unit 34 provides reactive power output control unit 31 with a command 38 to inhibit a change in reactive power output command value 36 for a period of the Zs measurement mode. As a result, for the period of the Zs measurement mode, reactive power Qo to be injected from reactive power output unit 32 into power system 100 is not changed.

In a case where output limit command unit 34 is not provided, there is a possibility that, when reactive power compensation device 10 injects minute reactive power ΔQ into power system 100 in the Zs measurement mode and causes a change in the system voltage, the other reactive power compensation device 30 may detect the change in the system voltage and output reactive power Qo to suppress the change in the system voltage. In such a case, reactive power compensation device 10 cannot detect change amount ΔV of the system voltage corresponding to change amount ΔQ of the minute reactive power correctly, and thus the system impedance cannot be calculated correctly. Since reactive power compensation device 10 in accordance with Embodiment 5 is designed so as not to be affected by the other reactive power compensation device 30 provided in the vicinity thereof in the Zs measurement mode, the system impedance can be detected more accurately.

Figure 12:
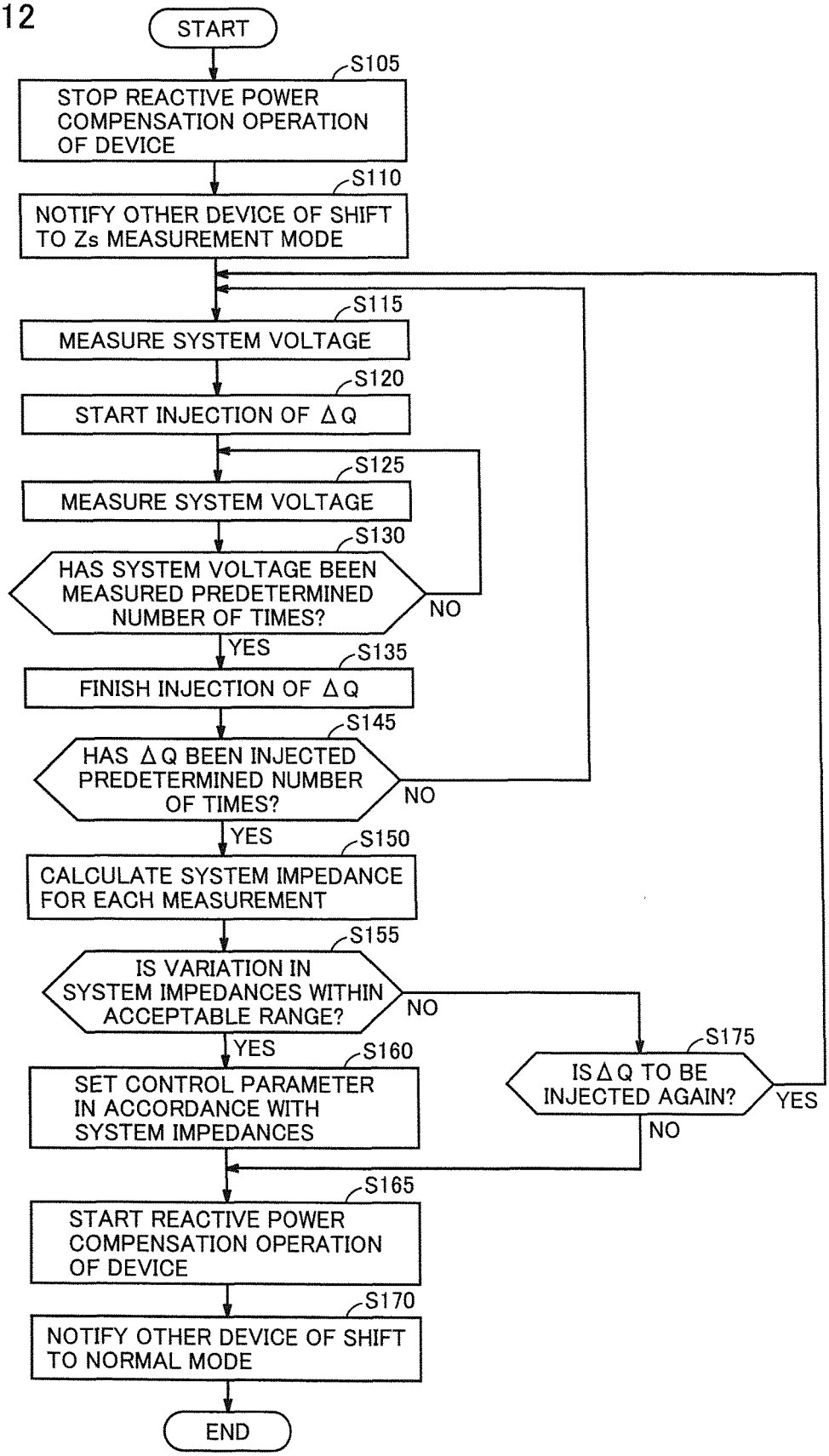
FIG. 12 is a flowchart illustrating an operation of a first reactive power compensation device in FIG. 11 in the Zs measurement mode.

FIG. 12 is a flowchart illustrating an operation of reactive power compensation device 10 in FIG. 11 in the Zs measurement mode. The flowchart of FIG. 12 is different from the flowchart of FIG. 3 in that step S110 is provided after step S105 and step S170 is provided after step S165.

Specifically, in step S110, when a shift from the normal mode to the Zs measurement mode occurs, reactive power output control unit 11 of reactive power compensation device 10 notifies the other reactive power compensation device 30 of information 41 regarding the shift, via communication device 40. In step S170, when a shift from the Zs measurement mode to the normal mode occurs, reactive power output control unit 11 of reactive power compensation device 10 notifies the other reactive power compensation device 30 of information 41 regarding the shift, via communication device 40. Since other steps in FIG. 12 are identical to those in the flowchart of FIG. 3 or 10, identical or corresponding parts will be designated by the same reference numerals and the description thereof will not be repeated.

Embodiment 6

Figure 13:
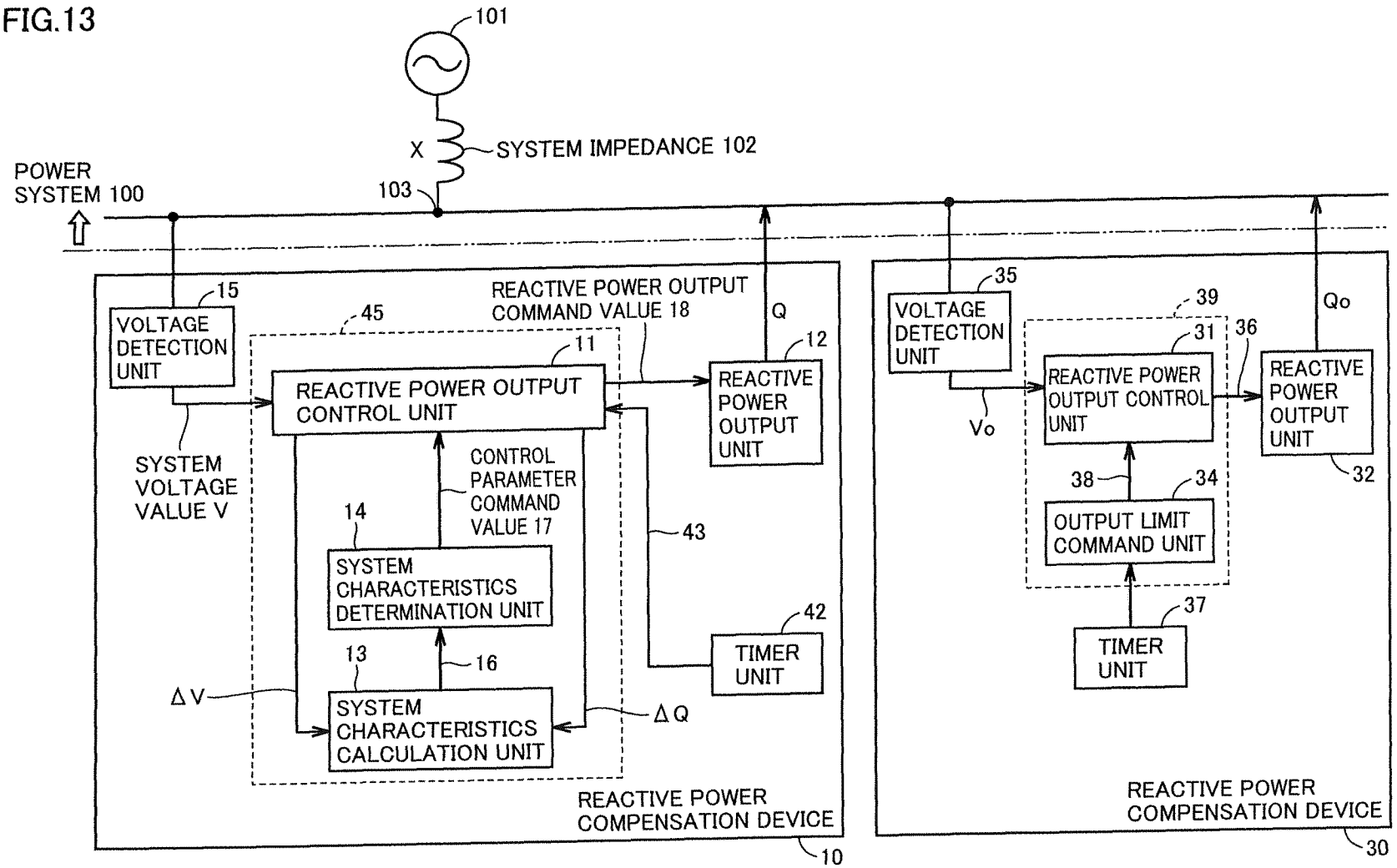
FIG. 13 is a block diagram showing a configuration of reactive power compensation devices in accordance with Embodiment 6.

FIG. 13 is a block diagram showing a configuration of reactive power compensation devices 10, 30 in accordance with Embodiment 6. Referring to FIG. 13, reactive power compensation device 10 is different from reactive power compensation device 10 in FIG. 11 in that it includes a timer unit 42 measuring a date and time, instead of communication device 40.

Figure 14:
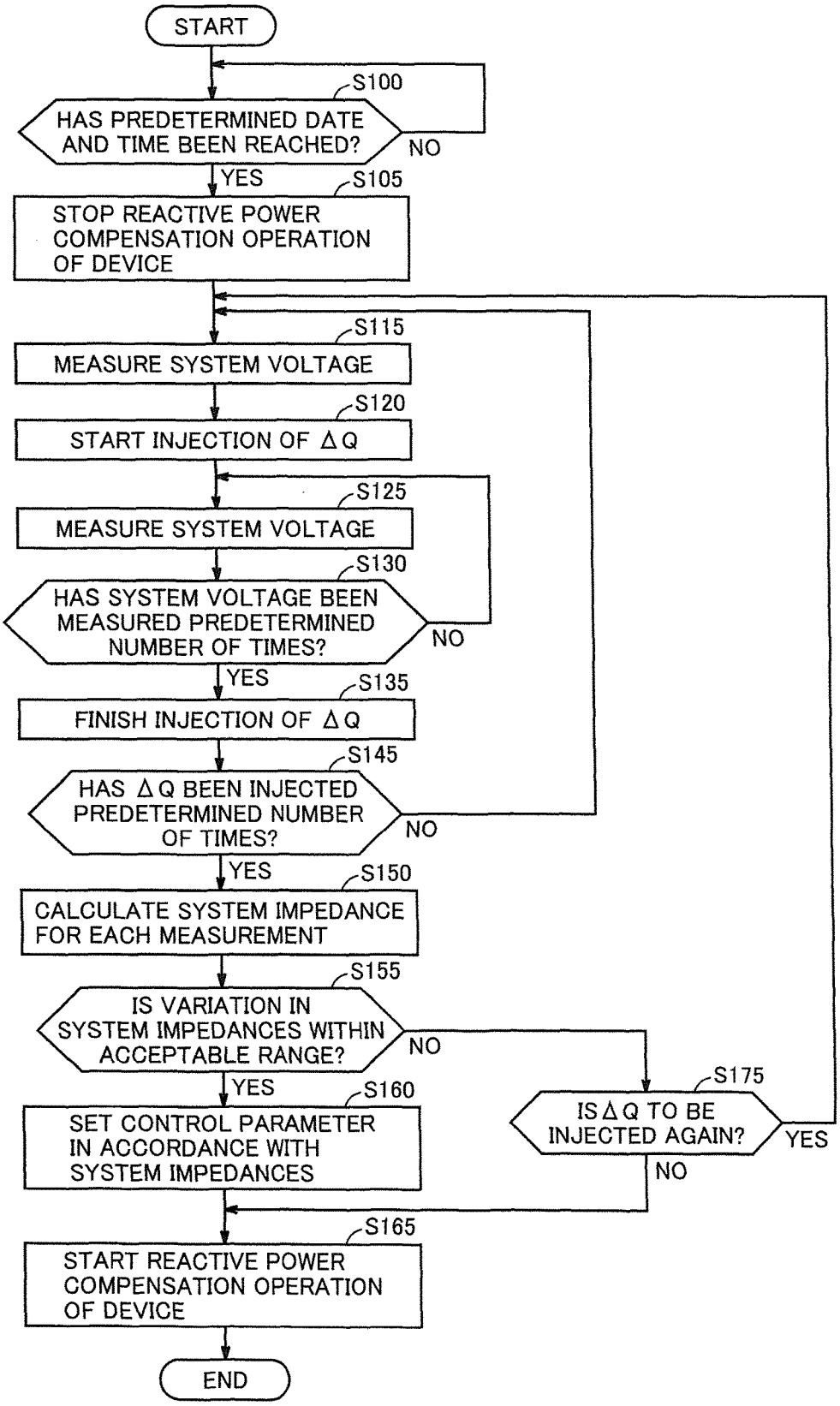
FIG. 14 is a flowchart illustrating an operation of a first reactive power compensation device in FIG. 13 in the Zs measurement mode.

FIG. 14 is a flowchart illustrating an operation of reactive power compensation device 10 in FIG. 13 in the Zs measurement mode. Referring to FIGS. 13 and 14, when reactive power output control unit 11 of reactive power compensation device 10 is notified of information 43 that a predetermined date and time has been reached, from timer unit 42 (YES in step S100), reactive power output control unit 11 shifts from the normal mode to the Zs measurement mode. Other than that, FIG. 14 is identical to FIG. 3 or 10, and thus identical or corresponding parts will be designated by the same reference numerals and the description thereof will not be repeated.

Referring to FIG. 13 again, reactive power compensation device 30 is different from reactive power compensation device 30 in FIG. 11 in that it includes a timer unit 37 measuring a date and time, instead of communication device 33.

Figure 15:
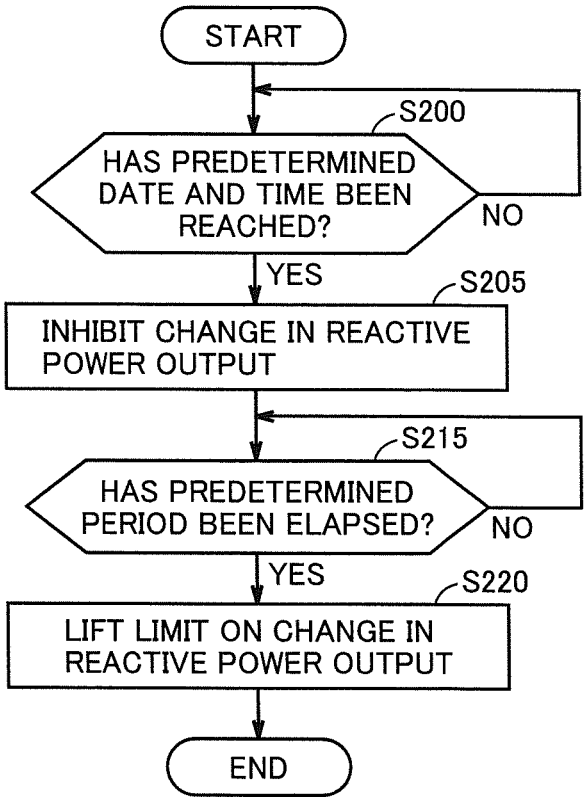
FIG. 15 is a flowchart illustrating an operation of an output limit command unit of a second reactive power compensation device in FIG. 13.

FIG. 15 is a flowchart illustrating an operation of output limit command unit 34 of reactive power compensation device 30 in FIG. 13. Referring to FIGS. 13 and 15, when output limit command unit 34 of reactive power compensation device 30 is notified that the predetermined date and time (the same date and time as that for timer unit 42) has been reached, from timer unit 37 (YES in step S200), output limit command unit 34 provides reactive power output control unit 31 with command 38 to inhibit a change in reactive power output command value 36 (step S205). As a result, reactive power Qo to be injected from reactive power output unit 32 into power system 100 is not changed.

Further, when output limit command unit 34 is notified that a predetermined period (also referred to as an output limit period) equivalent to a period in which the operation mode of reactive power compensation device 10 is the Zs measurement mode has been elapsed, from timer unit 37 (YES in step S215), output limit command unit 34 provides reactive power output control unit 31 with command 38 to lift the limit on the change in reactive power output (step S220). As a result, reactive power Qo in accordance with detected system voltage Vo is injected from reactive power output unit 32 into power system 100.

As described above, since reactive power compensation device 10 in accordance with Embodiment 6 is not affected by the other reactive power compensation device 30 provided in the vicinity thereof in the Zs measurement mode, the system impedance can be detected more accurately.

It is noted that each of timer units 42, 37 is preferably provided with a time synchronization device such as a GPS (Global Positioning System) receiving device. By being provided with the time synchronization device, each of timer units 42, 37 can completely match timing at which reactive power compensation device 10 shifts to the Zs measurement mode to timing at which a change in the reactive power to be output from reactive power compensation device 30 is inhibited.

Embodiment 7

Figure 16:
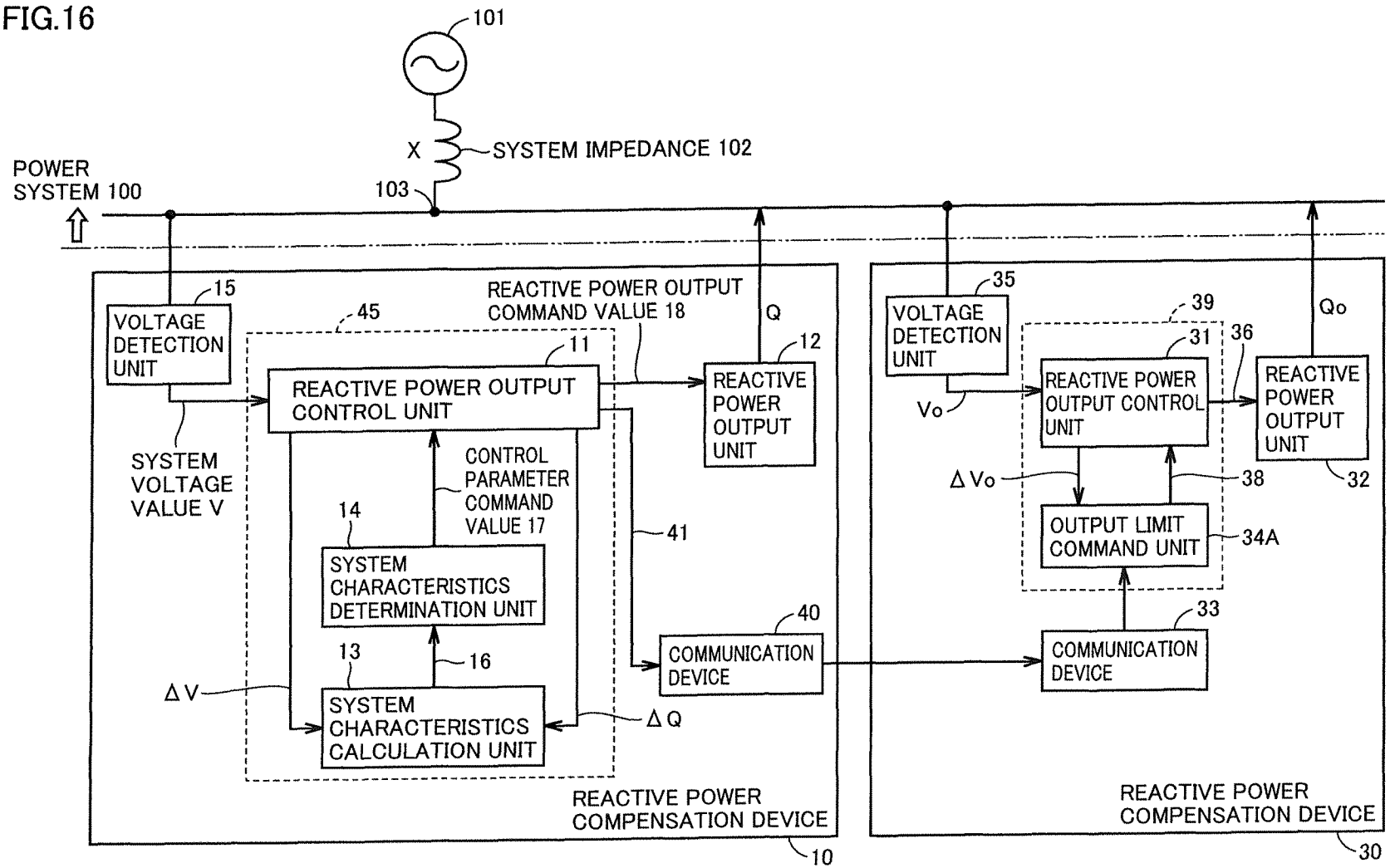
FIG. 16 is a block diagram showing a configuration of reactive power compensation devices in accordance with Embodiment 7.

FIG. 16 is a block diagram showing a configuration of reactive power compensation devices 10, 30 in accordance with Embodiment 7. Embodiment 7 is a modification of Embodiment 5. Specifically, an operation of an output limit command unit 34A of reactive power compensation device 30 in FIG. 16 is different from an operation of output limit command unit 34 in FIG. 11.

In the case of FIG. 16, even in a case where output limit command unit 34A provides reactive power output control unit 31 with command 38 to inhibit a change in reactive power output, if system voltage Vo detected by voltage detection unit 35 is significantly changed to exceed an acceptable change amount due to a system failure or the like, output limit command unit 34A provides reactive power output control unit 31 with command 38 to lift the limit on the change in output. Thereby, it is possible to promptly respond to the system failure. Other than that, FIG. 16 is identical to FIG. 11, and thus identical or corresponding parts will be designated by the same reference numerals and the description thereof will not be repeated.

Also in Embodiment 6, the same modification as that in Embodiment 7 can be made. Specifically, in FIG. 13, even in a case where output limit command unit 34 provides reactive power output control unit 31 with command 38 to inhibit a change in reactive power output (i.e., even within the output limit period described above), if system voltage Vo detected by voltage detection unit 35 is significantly changed to exceed an acceptable change amount due to a system failure or the like, output limit command unit 34 may provide reactive power output control unit 31 with command 38 to lift the limit on the change in output.

Modifications of Embodiments 5 to 7

Each of Embodiments 2 to 4 can be combined with any of Embodiments 5 to 7. Specifically, minute reactive power ΔQ injected into power system 100 in the Zs measurement mode may have a rectangular waveform, or a triangular waveform, or a waveform generated by applying a first-order lag transfer function to a rectangular wave. Further, a plurality of output change periods may be provided in the Zs measurement mode. Also in a case where the plurality of output change periods are provided, minute reactive power ΔQ in each output change period may have a rectangular waveform, or a triangular waveform, or a waveform generated by applying a first-order lag transfer function to a rectangular wave.

Although the embodiments of the present invention have been described, it should be understood that the embodiments disclosed herein are illustrative and non-restrictive in every respect. The scope of the present invention is defined by the scope of the claims, and is intended to include any modifications within the scope and meaning equivalent to the scope of the claims.

What is claimed is:

1. A reactive power compensation device, comprising:

a reactive power output unit outputting reactive power to a power system;

a voltage detection unit detecting a system voltage of said power system; and a control unit having first and second operation modes, wherein, in said first operation mode, said control unit controls a magnitude of the reactive power to be output by said reactive power output unit, based on the detected system voltage and one or more control parameters, and thereby adjusts the system voltage to be within a prescribed range or to be a prescribed value, and wherein, in said second operation mode, said control unit provides an output change period, changes the magnitude of the reactive power to be output by said reactive power output unit to said power system in said output change period, calculates, for adjusting said one or more control parameters, a plurality of system impedances of said power system at a plurality of detection time points within said output change period, based on change amounts of the system voltage detected at said plurality of detection time points and corresponding change amounts of the reactive power, evaluates a variation between the calculated system impedances, and, based on the evaluated variation, determines whether to adjust said one or more control parameters based on the calculated system impedances.

2. The reactive power compensation device according to claim 1, wherein a changed portion of the reactive power output from said reactive power output unit in said output change period has a triangular waveform.

3. The reactive power compensation device according to claim 1, wherein a changed portion of the reactive power output from said reactive power output unit in said output change period has a waveform generated by applying a first-order lag transfer function to a rectangular wave.

4. The reactive power compensation device according to claim 1, wherein, in said second operation mode, said control unit provides a plurality of said output change periods, changes the magnitude of the reactive power to be output by said reactive power output unit to said power system in each of said output change periods, calculates, for adjusting said one or more control parameters, a plurality of system impedances of said power system at a plurality of detection time points within each of said output change periods, based on change amounts of the system voltage detected at said plurality of detection time points within each of said output change periods and corresponding change amounts of the reactive power, evaluates a variation between the calculated system impedances in each of said output change periods and a variation of the calculated system impedances between said output chance periods, and, based on the evaluated variations, determines whether to adjust said one or more control parameters based on the calculated system impedances.

5. The reactive power compensation device according to claim 4, wherein changed portions of the reactive power output from said reactive power output unit in the plurality of said output change periods have a waveform which includes at least one of a triangular waveform and a waveform generated by applying a first-order lag transfer function to a rectangular wave.

6. A reactive power compensation system, comprising first and second reactive power compensation devices connected to a power system, said first reactive power compensation device including:

a first reactive power output unit outputting reactive power to said power system;

a first voltage detection unit detecting a system voltage of said power system;

a first communication device capable of communicating with a second communication device provided in said second reactive power compensation device; and a first control unit having first and second operation modes, wherein, in said first operation mode, said first control unit controls a magnitude of the reactive power to be output by said first reactive power output unit, based on the system voltage detected by said first voltage detection unit and one or more control parameters, and thereby adjusts the system voltage to be within a prescribed range or to be a prescribed value, wherein, when said first control unit shifts from said first operation mode to said second operation mode, said first control unit notifies the second communication device provided in said second reactive power compensation device of information regarding the shift of the operation mode, via said first communication device, and wherein, in said second operation mode, said first control unit further provides an output change period, changes the magnitude of the reactive power to be output by said first reactive power output unit to said power system in said output change period, calculates, for adjusting said one or more control parameters, a plurality of system impedances of said power system at a plurality of detection time points within said output change period, based on change amounts of the system voltage detected at said plurality of detection time points and corresponding change amounts of the reactive power, evaluates a variation between the calculated system impedances, and, based on the evaluated variation, determines whether to adjust said one or more control parameters based on the calculated system impedances, said second reactive power compensation device including:

a second reactive power output unit outputting reactive power to said power system;

a second voltage detection unit detecting the system voltage of said power system;

the second communication device capable of communicating with the first communication device provided in said first reactive power compensation device; and a second control unit configured to control a magnitude of the reactive power to be output by said second reactive power output unit, based on the system voltage detected by said second voltage detection unit, and thereby to adjust the system voltage to be within a prescribed range or to be a prescribed value, wherein, when said second control unit detects, via said second communication device, that said first control unit has shifted from said first operation mode to said second operation mode, said second control unit does not change the reactive power to be output by said second reactive power output unit to said power system for a period of said second operation mode.

7. The reactive power compensation system according to claim 6, wherein, based on comparison between the system voltage detected by said second voltage detection unit before a shift to said second operation mode and that after the shift to said second operation mode, said second control unit determines whether to adjust the magnitude of the reactive power to be output by said second reactive power output unit, based on the detected system voltage, even in said second operation mode.

8. The reactive power compensation system according to claim 6, wherein a changed portion of the reactive power output from said first reactive power output unit in said output change period has a triangular waveform.

9. The reactive power compensation system according to claim 6, wherein a changed portion of the reactive power output from said first reactive power output unit in said output change period has a waveform generated by applying a first-order lag transfer function to a rectangular wave.

10. The reactive power compensation system according to claim 6, wherein, in said second operation mode, said first control unit provides a plurality of said output change periods, changes the magnitude of the reactive power to be output by said first reactive power output unit to said power system in each said output change period, calculates, for adjusting said one or more control parameters, a plurality of system impedances of said power system at a plurality of detection time points within each said output change period, based on change amounts of the system voltage detected at said plurality of detection time points within each said output change period and corresponding change amounts of the reactive power, evaluates a variation between the calculated system impedances in each of said output change periods and a variation of the calculated system impedances between said output change periods, and, based on the evaluated variations, determines whether to adjust said one or more control parameters based on the calculated system impedances.

11. The reactive power compensation system according to claim 10, wherein changed portions of the reactive power output from said first reactive power output unit in the plurality of said output change periods have a waveform which includes at least one of a triangular waveform and a waveform generated by applying a first-order lag transfer function to a rectangular wave.

12. A reactive power compensation system, comprising first and second reactive power compensation devices connected to a power system, said first reactive power compensation device including:

a first reactive power output unit outputting reactive power to said power system;

a first voltage detection unit detecting a system voltage of said power system;

a first timer unit measuring a date and time; and a first control unit having first and second operation mode, wherein, in said first operation mode, said first control unit controls a magnitude of the reactive power to be output by said first reactive power output unit, based on the system voltage detected by said first voltage detection unit and one or more control parameters, and thereby adjusts the system voltage to be within a prescribed range or to be a prescribed value, wherein said first control unit shifts to said second operation mode from said first operation mode when said first timer unit detects that a predetermined date and time has been reached, and returns to said first operation mode when a predetermined period has elapsed from said predetermined date and time, and wherein, in said second operation mode, said first control unit provides an output change period, changes the magnitude of the reactive power to be output by said first reactive power output unit to said power system in said output change period, calculates, for adjusting said one or more control parameters, a plurality of system impedances of said power system at a plurality of detection time points within said output change period, based on change amounts of the system voltage detected at said plurality of detection time points and corresponding change amounts of the reactive power, evaluates a variation between the calculated system impedances, and, based on the evaluated variation, determines whether to adjust said one or more control parameters based on the calculated system impedances, said second reactive power compensation device including:

a second reactive power output unit outputting reactive power to said power system;

a second voltage detection unit detecting the system voltage of said power system;

a second timer unit measuring a date and time; and a second control unit configured to control a magnitude of the reactive power to be output by said second reactive power output unit, based on the system voltage detected by said second voltage detection unit, and thereby to adjust the system voltage to be within a prescribed range or to be a prescribed value, wherein, when said second timer unit detects that said predetermined date and time has been reached, said second control unit does not change the reactive power to be output by said second reactive power output unit to said power system until said predetermined period has been elapsed.

13. The reactive power compensation system according to claim 12, wherein, based on comparison between the system voltage detected by said second voltage detection unit before said predetermined date and time is reached and that after said predetermined date and time is reached, said second control unit determines whether to adjust the magnitude of the reactive power to be output by said second reactive power output unit, based on the detected system voltage, even before said predetermined period is elapsed.

14. The reactive power compensation system according to claim 12, wherein a changed portion of the reactive power output from said first reactive power output unit in said output change period has a triangular waveform.

15. The reactive power compensation system according to claim 12, wherein a changed portion of the reactive power output from said first reactive power output unit in said output change period has a waveform generated by applying a first-order lag transfer function to a rectangular wave.

16. The reactive power compensation system according to claim 12, wherein, in said second operation mode, said first control unit provides a plurality of said output change periods, changes the magnitude of the reactive power to be output by said first reactive power output unit to said power system in each said output change period, calculates, for adjusting said one or more control parameters, a plurality of system impedances of said power system at a plurality of detection time points within each said output change period, based on change amounts of the system voltage detected at said plurality of detection time points within each said output change period and corresponding change amounts of the reactive power, evaluates a variation between the calculated system impedances in each of said output change periods and a variation of the calculated system impedances between said output change periods, and, based on the evaluated variations, determines whether to adjust said one or more control parameters based on the calculated system impedances.

17. The reactive power compensation system according to claim 16, wherein changed portions of the reactive power output from said first reactive power output unit in the plurality of said output change periods have a waveform which includes at least one of a triangular waveform and a waveform generated by applying a first-order lag transfer function to a rectangular wave.

* * * * *